US008449370B2

(12) United States Patent
Koyama et al.

(10) Patent No.: US 8,449,370 B2
(45) Date of Patent: May 28, 2013

(54) GAME DEVICE AND GAME SYSTEM CAPABLE OF DETECTING GAMING MEDIA

(75) Inventors: Toshimi Koyama, Tokyo (JP); Jun Fujimoto, Tokyo (JP)

(73) Assignee: Universal Entertainment Corporation, Tokyo (JP)

( * ) Notice: Subject to any disclaimer, the term of this patent is extended or adjusted under 35 U.S.C. 154(b) by 937 days.

(21) Appl. No.: 12/245,410

(22) Filed: Oct. 3, 2008

(65) Prior Publication Data

US 2009/0093293 A1 Apr. 9, 2009

(30) Foreign Application Priority Data

Oct. 5, 2007 (JP) ..... 2007-262154

(51) Int. Cl.
*G08B 13/14* (2006.01)

(52) U.S. Cl.
USPC ..... 463/17; 463/16; 463/25; 340/572.7; 340/572.1

(58) Field of Classification Search
USPC ..... 463/16–17
See application file for complete search history.

(56) References Cited

U.S. PATENT DOCUMENTS 5,651,548 A * 7/1997 French et al. ..... 463/25
5,919,090 A * 7/1999 Mothwurf ..... 463/25
6,629,591 B1 * 10/2003 Griswold et al. ..... 194/205
2002/0006829 A1 * 1/2002 Purton ..... 463/47
2006/0068878 A1 * 3/2006 Krenn et al. ..... 463/17
2007/0018793 A1 * 1/2007 Stewart et al. ..... 340/10.3
2007/0035399 A1 * 2/2007 Hecht et al. ..... 340/572.1
2007/0105618 A1 * 5/2007 Steil ..... 463/25
2007/0247284 A1 * 10/2007 Martin et al. ..... 340/10.1

FOREIGN PATENT DOCUMENTS

JP 2004-102953 4/2004
JP 2004-105321 4/2004

* cited by examiner

*Primary Examiner* — Ronald Laneau
*Assistant Examiner* — Justin Myhr
(74) *Attorney, Agent, or Firm* — Lexyoume IP Meister, PLLC.

(57) ABSTRACT

A plurality of readers (antennas ANT1 through ANT3) that are each disposed at each of a plurality of laying positions (betting positions) provided on a game table 2 and are used to read the identification information (RFID) from game media (game chips Pa through Pi) placed at any of the laying positions (betting positions), controller (an antenna controller 4) that performs the process of reading the identification information from the game medium by individually driving and controlling the readers and causing predetermined electromagnetic waves radiated from the readers in the direction passing through the laying position while changing the power level thereof, storage unit (antenna controller) that stores the identification information that has been read as the data of each reader while relating the data to the power level of the electromagnetic wave, and collating unit (antenna controller) that identifies the game medium by using the data of the different readers stored in the storage unit in order to collate the data of the adjoining readers with each other.

9 Claims, 3 Drawing Sheets

FIG.1B

| OUTPUT POWER OF ELECTROMAGNETIC WAVE | LEVEL 1 | LEVEL 2 | LEVEL 3 | LEVEL 4 | LEVEL 5 |
|---|---|---|---|---|---|
| ANT 1 | ID0001 | ID0001 | ID0001 | ID0001 | ID0001 |
| | ID0002 | ID0002 | ID0002 | ID0002 | ID0002 |
| | ID0003 | ID0003 | ID0003 | ID0003 | ID0003 |
| | ID0004 | ID0004 | ID0004 | ID0004 | |
| | ID0005 | ID0005 | ID0005 | ID0005 | |
| | ID0006 | ID0006 | ID0006 | | |
| | ID0007 | ID0007 | ID0007 | | |
| | ID0008 | ID0008 | ID0008 | | |
| | ID0009 | ID0009 | ID0009 | | |

FIG.1C

| OUTPUT POWER OF ELECTROMAGNETIC WAVE | LEVEL 1 | LEVEL 2 | LEVEL 3 | LEVEL 4 | LEVEL 5 |
|---|---|---|---|---|---|
| ANT 2 | ID0001 | ID0001 | ID0001 | ID0006 | ID0006 |
| | ID0002 | ID0002 | ID0002 | ID0007 | ID0007 |
| | ID0003 | ID0003 | ID0003 | | |
| | ID0004 | ID0004 | ID0004 | | |
| | ID0005 | ID0005 | ID0005 | | |
| | ID0006 | ID0006 | ID0006 | | |
| | ID0007 | ID0007 | ID0007 | | |

FIG.1D

| OUTPUT POWER OF ELECTROMAGNETIC WAVE | LEVEL 1 | LEVEL 2 | LEVEL 3 | LEVEL 4 | LEVEL 5 |
|---|---|---|---|---|---|
| ANT 3 | ID0001 | ID0001 | ID0001 | ID0008 | ID0008 |
| | ID0002 | ID0002 | ID0002 | ID0009 | ID0009 |
| | ID0003 | ID0003 | ID0003 | | |
| | ID0004 | ID0004 | ID0004 | | |
| | ID0005 | ID0005 | ID0005 | | |
| | ID0008 | ID0008 | ID0008 | | |
| | ID0009 | ID0009 | ID0009 | | |

GAME DEVICE AND GAME SYSTEM CAPABLE OF DETECTING GAMING MEDIA

CROSS REFERENCE TO RELATED APPLICATION

This application is based upon and claims the benefit of priority from the prior Japanese patent Application No. 2007-262154, filed on Oct. 5, 2007.

BACKGROUND OF THE INVENTION

1. Field of the Invention

The present invention relates to a game device and a game system for playing a game by placing desired number of game media (for example, game chips or game cards) that are assigned with predetermined identification information at any of a plurality of laying positions (for example, betting positions) disposed on a game table, and particularly to a technology for identifying the game media placed at the laying positions.

2. Description of Related Art

To play a game at a gaming house such as casino, a player exchanges a predetermined currency for game media such as game chips or game cards. After playing a game such as roulette or card game by using the game chips or the like, the player exchanges the game chips or the like obtained through the game for the predetermined currency.

In the case of roulette, for example, each player is provided with game chips of a distinct color so that the players can be identified when they place bets. The game chips are provided with (by indentation for example) particular numerical figures or markings that indicate the values (for example, 1, 5, 10, 100 cents, etc.) which the game chips represent, so that a dealer can easily distinguish their values. Upon completion of each game, each player receives a quantity of game chips according to the value of the game chips betted and the odds assigned to the betted position, then the game goes on. The players are entitled to exchange the game chips received during the game for currency at any time.

Recently in games as described above, systems have been introduced that employ game chips having IC tags each containing a unique identification code and a value code indicating the values of the game chip embedded therein, so as to smoothly carry out the game while checking the identification codes, etc.

In a table game such as roulette, a plurality of laying positions (for example, betting positions where game chips are placed) are disposed adjoining each other on a game table, and therefore each laying position (betting position) may have a very small area. This results in such a problem as, when many players participate in a game at the same time, the game chips placed at a betting position by the players are disposed too close to adjacent betting positions.

In order to correctly recognize the state of disposal of the game chips placed by the players at the laying positions without disturbing the progression of the game, various measures have been taken by making use of IC tags embedded in the game chips.

For example, Japanese Patent Unexamined Publication No. 2004-105321 and Japanese Patent Unexamined Publication No. 2004-102953 disclose such a constitution of table-shaped game device that has antenna for radiating electromagnetic wave in X direction (for example, the direction along the longer side) of the game table and antenna for radiating electromagnetic wave in Y direction (for example, the direction along the shorter side), so as to read the information of the IC tag embedded in the game chip. In such a game device, the electromagnetic waves radiated in X direction and Y direction generate a flux wave in an upward vertical direction on the table surface of the game device at the cross point where the electromagnetic waves in both directions cross each other. Thus the state of the game chips being placed is detected by reading the information of the IC tag embedded in game chips placed on the cross point. In this case, each cross point is located to correspond to each betting position where the player places the game chips.

SUMMARY OF THE INVENTION

The game devices disclosed in Japanese Patent Unexamined Publication No. 2004-105321 and Japanese Patent Unexamined Publication No. 2004-102953, have such a constitution that all cross points are scanned sequentially while sending the flux waves in the same direction (upward vertical to the table surface) at each cross point when detecting the state of the game chips being placed. In this case, since the flux waves are sent in the same direction (upward vertical to the table surface) at each cross point, the waves (specifically magnetic flux) diffuse along concentric circles according to Ampere's corkscrew rule. As a result, there is a possibility of detecting the state of game chips placed at an adjacent cross point (adjacent betting position) in addition to that at the cross point (namely the betting position) that is the target of detection, depending on the output power level (magnitude) of the flux wave that is sent.

Thus in order to prevent an erroneous detection as described above, a separate means of controlling the output power must be provided to decrease the output power of the flux wave. However, when the output power is made too low, there is a possibility that the state of the intended game chips cannot be detected (unable to precisely read the information of the IC tags embedded in the game chips) when many game chips are stacked at the target cross point (betting positions).

The present invention has been devised to solve the problems described above, and an object of the invention is to provide a game device and a game system that are capable of accurately identifying the game media placed at the laying position.

In order to achieve the object, the first invention is constituted from a game table where a plurality of laying positions (for example, betting positions) are disposed and a desired number of game media assigned with predetermined identification information (for example, game chips or game cards) can be placed at any of the plurality of laying positions, a plurality of readers (for example, antenna) that are disposed at the plurality of laying positions and are used to read the identification information from the game medium placed at the laying position, a controller (for example, an antenna controller having RFID reading function) that performs the process of reading the identification information from the game medium placed at the laying position by controlling the plurality of readers and radiating predetermined electromagnetic waves from the readers in the direction passing through the laying position while changing the output power, a storage unit (for example, an antenna controller having RFID reading function) that stores the identification information that has been read by the controller as the data for each reader while relating the data to the power level of the electromagnetic wave radiated by the reader, and a collating unit (for example, an antenna controller having RFID reading function) that identifies the game medium placed at the laying position by using the data of the different readers stored in the storage unit in order to collate the data of the adjoining readers with each other.

According to the first invention, since the identification information from the game medium is read while varying the output power of the electromagnetic waves, problems arising from reading the identification information in duplex from the game medium placed at laying positions that adjoin each other can be avoided. As a result, it is possible to accurately identify the game media placed at the laying positions (specifically, the position where the game media are placed, the number and type of the game media).

Second invention is constituted from a game device that comprises a game table where a plurality of laying positions are disposed and a desired number of game media assigned with predetermined identification information can be placed at any of the laying positions, a plurality of readers that are respectively disposed at the plurality of laying positions and are used to read the identification information from the game medium placed at the laying position, a controller that performs the process of reading the identification information from the game medium placed at the laying position by controlling the plurality of readers and having predetermined electromagnetic waves radiated from the readers in the direction passing through the laying position while changing the output power thereof, and a transmitting unit that sends the identification information that has been read by the controller to the outside as data from each reader by relating the data to the power level of the electromagnetic wave radiated by the reader; and an administration server that comprises a receiver that receives the data from each reader that have been transmitted by the transmitting unit, a storage unit that stores the data from each reader received by the receiver, and a collating unit that identifies the game medium placed at the laying position by using the data of the different readers stored in the storage unit in order to collate the data of the adjoining readers with each other.

According to the second invention, since the identification information from the game media is read while varying the output power of the electromagnetic waves, problems arising from reading the identification information in duplex from the game media placed at laying positions that adjoin each other can be avoided. As a result, the game media placed at the laying position (specifically, the position where the game media are placed, the number and type of the game media) can be accurately identified.

The present invention provides a game device and game system capable of accurately identifying game media placed at laying positions.

BRIEF DESCRIPTION OF THE DRAWINGS

Other and further objects, features and advantages of the invention will appear more fully from the following description taken in connection with the accompanying drawings in which:

FIG. 1B is a diagram showing an example of game medium identification information that is read by antenna 1 according to the change in output power of electromagnetic waves.

FIG. 1C is a diagram showing an example of game medium identification information that is read by antenna 2 according to the change in output power of electromagnetic waves.

FIG. 1D is a diagram showing an example of game medium identification information that is read by antenna 3 according to the change in output power of electromagnetic waves.

DESCRIPTION OF THE PREFERRED EMBODIMENTS

Now the game device according to one embodiment of the present invention will be described.

The game device of this embodiment is adapted for use with a game played by placing desired number of game media (for example, game chips or game cards) having predetermined identification information assigned therewith at any of a plurality of laying positions (for example, betting positions) disposed on a game table. While games as described above include various games that use game chips such as medals and coins or cards (for example, roulette, card games, etc.), the description that follows will use roulette, that uses game chips as the game media, as an example.

Figure 2:
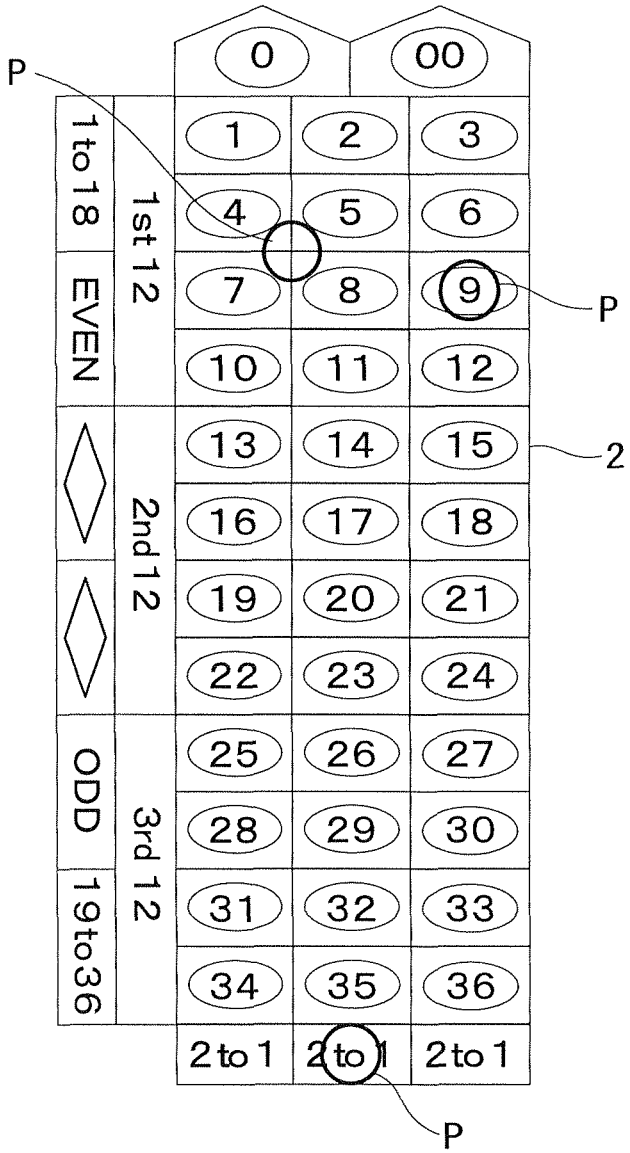
FIG. 2 is a plan view showing the constitution of a betting board used as a game table whereon a desired number of game media (game chips) assigned with predetermined identification information are placed to play a game, as an example of game device for playing a roulette game.

Roulette is played on a betting board 2 as shown in FIG. 2 used as the game table 2, where the betting board 2 has a plurality of laying positions (for example, betting positions) whereon players place a desired number of game chips P. As a dealer turns a roulette wheel (not shown) and throws a roulette ball (not shown) onto the roulette wheel, each player of the game places a desired number of game chips P from those in hand at a betting position on the betting board 2. The drawing shows an example of a betting situation where the game chips P are placed at betting positions such as corners (4, 5, 7, 8), straight (9) and column (2 to 1).

When roulette is played with the game device of this embodiment, it is possible to determine the betting position where the game chips P are placed, the number and type of the game chips that are betted, with respect to the betting positions disposed at a plurality of points over the betting board 2 including the betting positions described above.

Figure 1A:
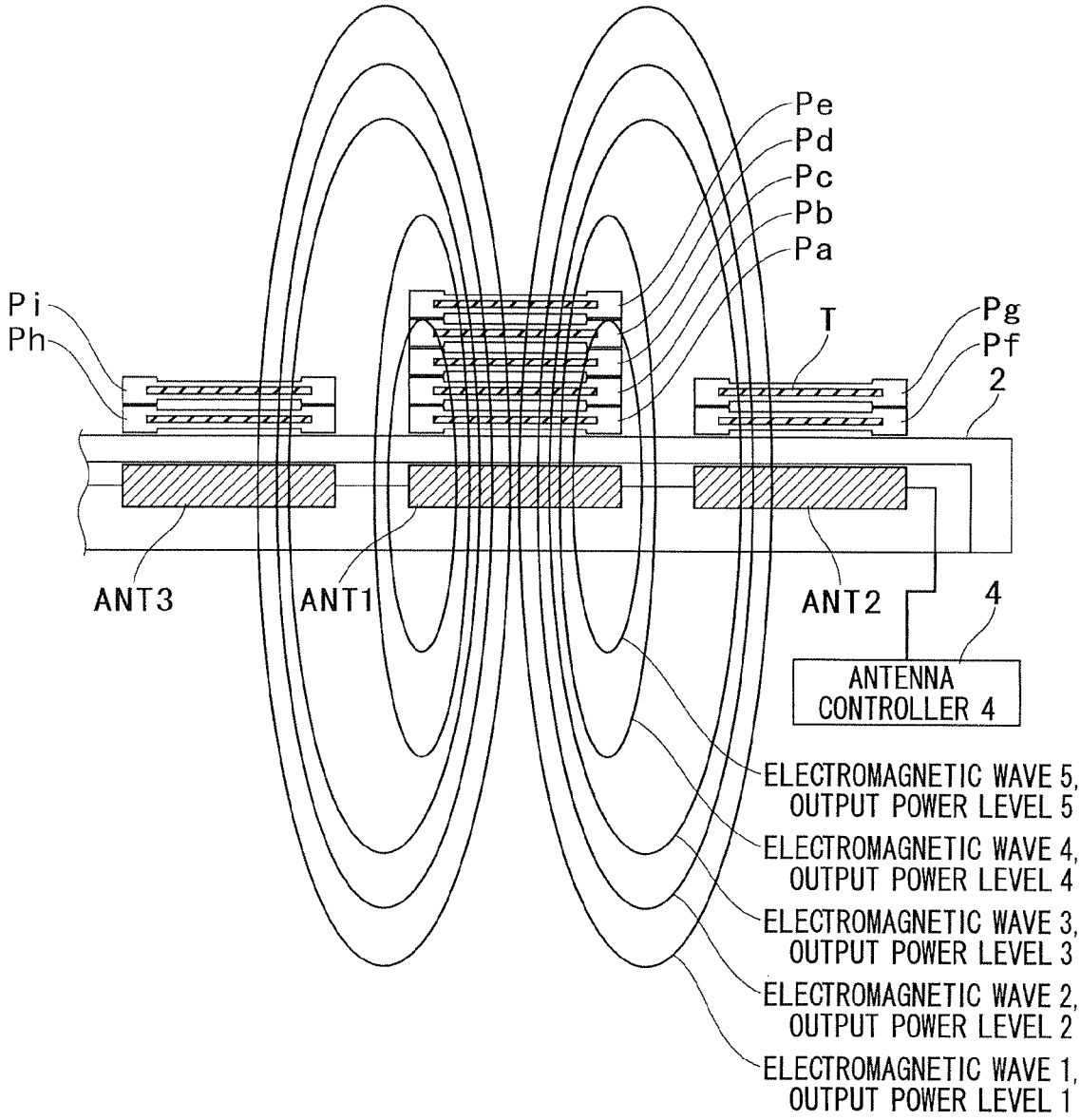
FIG. 1A is a sectional view showing the constitution of a game device according to one embodiment of the present invention.

In order to realize the operation and effect described above, the game device of this embodiment has a plurality of readers that are each disposed at one of the plurality of betting positions as shown in FIG. 1A, and are used to read the identification information from the game media (game chips Pa through Pi in the example shown) placed at the betting positions. Each of the game chips Pa through Pi has embedded therein a wireless IC chip T having RFID that is assigned with unique identification information, so that the identification information assigned to the wireless IC chip T is read via the readers.

The readers may be antennas (antennas ANT1 through ANT3 are shown as example in the drawing) that are capable of radiating predetermined electromagnetic waves in a direction passing through the betting position. One antenna is disposed on the back of the betting board 2 opposing each betting position. Shown in FIG. 1A, for example, are the antennas ANT1 through ANT3 disposed respectively at three adjacent betting positions, with desired numbers of the game chips Pa through Pi being placed at the betting positions by the players of the game. With this constitution, there are no restrictions on the betting positions, the number of game chips P or the type of game chips P that can be detected via the antennas ANT1 through ANT3.

The game device of this embodiment has a controller that individually drives and controls the plurality of readers (for example, antennas ANT1 through ANT3). The controller may be an antenna controller 4 that has RFID reading function, which is connected to the readers (the antennas ANT1 through ANT3). Shown in FIG. 1A, for example, is one antenna controller 4 connected to the antennas ANT1 through ANT3 that are disposed respectively three adjacent betting positions. In this manner, no limitation is imposed on the number of the readers (antennas ANT1 through ANT3) that can be driven and controlled by the antenna controller 4.

In this case, the antenna controller 4 individually drives and controls the readers (for example, antennas ANT1 through ANT3), so as to cause predetermined electromagnetic waves to be radiated from the readers (the ANT1 through ANT3) in the direction passing through the betting position while changing the power level thereof. Specifically, the plurality of readers (three antennas ANT1 through ANT3 are shown as an example in the drawing) that are disposed on the betting board 2 are individually driven and controlled and, when one reader (for example, the antenna ANT1) is driven and controlled, all the other readers (for example, antennas ANT2 and ANT3) are not caused to radiate electromagnetic waves. Accordingly, predetermined electromagnetic waves are radiated from only one reader (that is, the antenna ANT1) in the direction passing through the betting position while changing the power level thereof.

Thus the extent of the magnetic field of the electromagnetic wave radiated by one reader (the antenna ANT1) is controlled by changing the output power by means of the antenna controller 4. The electromagnetic wave passes through the betting position in this state and is received by the reader (the antenna ANT1). As the signal from the electromagnetic wave is sent to the antenna controller 4, the state of the reader (the antenna ANT1) is detected by the antenna controller 4 according to the signal from the electromagnetic wave.

When game chips (five game chips Pa through Pe in the example shown in the drawing) are placed at the betting position opposite the antenna ANT1, if the power level of the electromagnetic wave radiated by the antenna ANT1 is varied so that the magnetic field covers all the game chips Pa through Pe, a change in the impedance due to the dielectric property of the game chips Pa through Pe causes the state of reception by the antenna controller 4 to change. At this time, the antenna controller 4 determines whether the presence or absence of the game chips Pa through Pe according to the change in the state of reception. As a result, it is possible to determine the positions of the game chips Pa through Pe placed at the plurality of betting positions on the betting board 2.

At the same time, the identification information transmitted by the wireless IC chips T of the game chips Pa through Pe is received via the reader (the antenna ANT1) and is sent to the antenna controller 4. The antenna controller 4 carries out a process of reading the identification information assigned to the game chips Pa through Pe (for example, unique identification number of each of the game chips Pa through Pe) from the identification signals. This makes it possible to determine the number and types of all of the game chips Pa through Pe that are placed at the betting positions.

When electromagnetic wave is radiated from the reader by the antenna controller 4, all of the game chips placed at the betting positions are included in the extent of the magnetic field of the electromagnetic wave, so that it is possible to determine the position, type and number of all game chips that are betted. FIG. 1A shows an example in which electromagnetic waves radiated with varying output power from a low power level 5 of wave 5 to a high power level 1 of wave 1 toward five game chips Pa through Pe that are placed at the betting position opposite the antenna ANT1. It can be seen that, the waves 4 through 1 having power levels 4 to 1 respectively cause the extent of the magnetic field to cover all of the five game chips Pa through Pe.

However, when the game chips (in the example shown in FIG. 1A, two game chips Pf, Pg on the right hand side in the drawing and two game chips Ph, Pi on the left hand side in the drawing) are placed at other betting positions that adjoin the betting positions where the game chips Pa through Pe are placed, the magnetic fields of the waves 3 through 1 having power levels 3 to 1, respectively, extend to the area that includes the other betting positions, thereby covering the game chips Pf through Pi placed on the other betting positions as well as the game chips Pa through Pe.

At this time, the signals sent from the antenna ANT1 to the antenna controller 4 include the change in the impedance due to the dielectric property of all the game chips Pa through Pi that adjoin each other. As a result, it is difficult to accurately identify only the game chips Pa through Pe that are placed at the betting position opposed to the antenna ANT1, by the antenna controller 4 in accordance to such a change in the reception state. Thus it is impossible to accurately determine the betting positions of the game chips Pa through Pe on the betting board 2.

At the same time, identification signals from the wireless IC chips T of all the game chips Pa through Pi that adjoin each other are received via the antenna ANT1, and are sent to the antenna controller 4. As a result, it is difficult to carry out the process of accurately reading the identification information of only the game chips Pa through Pe (identification numbers of the game chips Pa through Pe) that are placed at the betting position opposite to the antenna ANT1, by the antenna controller 4 in accordance to the identification signals. Thus it is impossible to accurately determine the number and types of the game chips Pa through Pe.

Accordingly, the game device of this embodiment is provided with a storage unit that stores the identification information that has been read by the controller (the antenna controller 4) as the data of each reader in correspondence to the power level of the electromagnetic wave radiated by the readers (the antennas ANT1 through ANT3 in the example shown in FIG. 1A), and a collating unit that identifies the game media placed at the betting positions (the game chips Pa through Pi in the example shown in the drawing) by checking the data from the adjoining readers against each other, among the data of the different readers stored in the storage unit.

For the storage unit, the antenna controller 4 that has an RFID reading function may be used. The antenna controller 4 has ID tables (refer to, for example, FIG. 1B through FIG. 1D) that store the identification information of the game media (the game chips Pa through Pi in the example shown in FIG. 1A) that have been read while varying the power level of the electromagnetic wave, as the data of each reader. The operation of varying the power level of the electromagnetic wave is carried out by the antenna controller 4 that individually drives and controls the reader (antenna) each provided for each of the betting positions.

When a game medium (game chip) placed at one betting position (hereinafter referred to as particular betting position) is identified, for example, only the reader (antenna) provided at the particular betting position is driven and controlled by the antenna controller 4 so as to change the power level of the electromagnetic wave that is radiated by the reader (antenna). At this time, electromagnetic waves of which power level is changed stepwise are radiated by the reader (antenna), and the identification information of the game medium (game chip)

that has been read with the electromagnetic wave is stored in the ID table as the data of each reader (hereinafter referred to as "designated data").

The extent to which the power level of the electromagnetic wave is changed (the amount of change) may be controlled in accordance to the number of game media (game chips) that are betted. For example, when a large number of game media (game chips) are betted, the power level of the electromagnetic wave is changed accordingly by a large amount. This causes all of the game media (game chips) to be covered by the magnetic field, so that the identification information is read from all of the game media and is stored in the ID table as the data of each reader.

Then the readers (antennas) disposed at the other betting positions that adjoin the particular betting position described above are similarly driven and controlled by the antenna controller 4 so as to change the power level of the electromagnetic wave radiated by the reader (antenna). At this time, the electromagnetic wave of which power level is changed stepwise is radiated by the reader (antenna), and the identification information of the game medium (game chip) that has been read with the electromagnetic wave is stored in the ID table as the data of each reader (hereinafter referred to as "other data").

After having the data of each of the readers that adjoin each other (designated data, other data) stored in the ID table as described above, the collating unit compares both sets of data (designated data and other data) for each power level of the electromagnetic wave, so as to determine the betting position where the game media (game chips) are placed, the number and type of the game media (game chips) that are placed at the particular betting position.

For the collating unit, the antenna controller 4 that has RFID reading function may be used. In this case, the antenna controller 4 compares the data of each of the readers that adjoin each other (designated data and other data) stored in the ID table against each other. Then the antenna controller 4 sorts the data into common parts having the same identification information and different parts having different identification information, and calculates the power level of the signal having only the different part without the common part. Based on the identification information for the power level that has been calculated, the betting position where the game media (game chips) are placed, the number and type of the game chips that are placed at the particular betting position are determined.

The various collation processes carried out in the antenna controller 4 that functions as the collating unit described above are executed by a CPU that runs a collation program stored in a ROM using a RAM as the operation area. The ROM, the RAM and the CPU (not shown) are provided in the antenna controller 4. The collation process is repeated for every reader each provided for each of the betting positions provided on the betting board 2, with respect to data from each of the readers that adjoin each other (designated data and other data) disposed at the particular betting position and the other betting position that adjoins therewith. Thus the position, number and type of the game media (game chips) that are betted for all of the betting positions provided on the betting board 2 are determined.

FIG. 1A shows an example where a plurality of game media (game chips Pa through Pi) are placed at each of three betting positions that adjoin each other, among the plurality of betting positions provided on the betting board 2. Now a method to identify the game medium (game chips) that are placed on the particular betting position according to the collation process described above in this state will be described, assuming that the betting position where the antenna ANT1 is disposed is the particular betting position. In the description that follows, in order to simplify the description, it is assumed that the antennas ANT1 through ANT3 shown in the drawing radiate electromagnetic waves 5 through 1 with the power level varied in five steps from level 5 to level 1.

When electromagnetic waves 5 through 1 are radiated from the reader provided at the particular betting position while varying the power level in five steps from level 5 to level 1, the extent of the magnetic field of the electromagnetic waves 3 through 1 with relatively high output power from level 3 to level 1 covers the adjacent betting positions, so as to cover all (9 chips) of the game chips Pa through Pi that are placed at the adjacent betting positions. As a result, identification information [ID0001 through ID0009] of the game chips Pa through Pi are read at the same time, and are stored in the ID table (FIG. 1B) in correspondence to the power levels 3 through 1.

With the electromagnetic wave 4 with relatively low power level of 4, the magnetic field does not extend to the adjacent betting position, so that only the five game chips Pa through Pe that are placed at the particular betting position opposite the antenna ANT1 are covered. As a result, only the identification information [ID0001 through ID0005] of the game chips Pa through Pe are read, and are stored in the ID table (FIG. 1B) in correspondence to the power level 4. With the electromagnetic wave 5 with the lowest power level of 5, the extent of the magnetic field is restricted to a small area, so that only three game chips Pa through Pc that are placed at the bottom of the pile of the five game chips Pa through Pe are covered. As a result, only the identification information [ID0001 through ID0003] of the game chips Pa through Pc are read, and are stored in the ID table (FIG. 1B) in correspondence to the power level 5. For the convenience of description, all the identification information stored in the ID table shown in FIG. 1B will be referred to as designated data.

When the radiation of electromagnetic waves from the antenna ANT1 is stopped, the readers (the antenna ANT2 and the antenna ANT3) disposed at the betting positions that adjoin the particular betting position are individually driven and controlled. In this case, while either the antenna ANT2 or the antenna ANT3 may be driven and controlled first, a case where the antenna ANT2 disposed at one of the betting position is driven and controlled first will be described as an example. When the electromagnetic waves 5 through 1 are radiated from the antenna ANT2 while varying the power level in five steps from level 5 to level 1, the electromagnetic waves 3 through 1 with relatively high output power from level 3 to level 1 have a magnetic field reaching the adjacent particular betting position, so as to cover all (7 chips) of the game chips Pa through Pg that are placed at the particular betting position and one betting position. As a result, the identification information [ID0001 through ID0007] of the game chips Pa through Pg are read at the same time, and are stored in the ID table (FIG. 1C) in correspondence to the power levels 3 through 1.

The magnetic field of the electromagnetic wave 4 with a relatively low power level of 4 does not reach the adjacent particular betting position, so that only two game chips Pf and Pg that are placed at the betting position opposite the antenna ANT1 are covered. As a result, only identification information [ID0006 and ID0007] of the game chips Pf and Pg are read at the same time, and are stored in the ID table (FIG. 1C) in correspondence to the power level 4. With the electromagnetic wave 5 with the lowest power level of 5, only the identification information [ID0006 and ID0007] of the game chips Pf and Pg is read, and is stored in the ID table (FIG. 1C)

in correspondence to the power level 4. For the convenience of description, all the identification information stored in the ID table shown in FIG. 1C will be referred to as the one data.

Then the antenna ANT3 disposed at the other betting position is driven and controlled. When the electromagnetic waves 5 through 1 are radiated from the antenna ANT3 while varying the power level in five steps from level 5 to level 1, the electromagnetic waves 3 through 1 with relatively high output power from level 3 to level 1 create a magnetic field reaching the adjacent particular betting position, so as to cover all (7 chips) of the game chips Pa through Pe, Ph and Pi that are placed at the particular betting position and the other betting position. As a result, identification information [ID0001 through ID0005, ID0008 and ID0009] of the game chips Pa through Pe, Ph and Pi is read at the same time, and is stored in the ID table (FIG. 1D) in correspondence to the power levels 3 through 1.

The magnetic field of the electromagnetic wave 4 with relatively low power level of 4 does not reach the adjacent particular betting position, so that only two game chips Ph and Pi that are placed at the other betting position opposite the antenna ANT3 are covered. As a result, only the identification information [ID0008 and ID0009] of the game chips Ph and Pi is read, and is stored in the ID table (FIG. 1D) in correspondence to the power level 4. With the electromagnetic wave 5 having the lowest power level, only the identification information [ID0008 and ID0009] of the game chips Ph and Pi are read, and are stored in the ID table (FIG. 1D) in correspondence to the power level 4. For the convenience of description, all the identification information stored in the ID table shown in FIG. 1D will be referred to as other data.

After having the data from the three adjacent antennas ANT1 through ANT3 (designated data, one data and other data) stored in the ID table as described above, the antenna controller 4 compares the three sets of data (designated data, one data and other data), so as to sort the data into common parts having the same identification information and different parts having different identification information, and calculates the power level of the signal having only a different part without a common part.

In this case, comparison of the three sets of data (designated data, one data and other data) results in the division of identification information of the common part [ID0001 through ID0005] and identification information of the different part [ID0006, ID0007] and [ID0008, ID0009]. At this time, it is determined that, at power level 4, the identification information of the three data sets comprises only different parts without a common part. Specifically, it is determined that the identification information that corresponds to the power level 4 of the antenna ANT1 is [ID0001 through ID0005], the identification information that corresponds to the power level 4 of the antenna ANT2 is [ID0006, ID0007] and the identification information that corresponds to the power level 4 of the antenna ANT3 is [ID0008, ID0009]

Then the antenna controller 4 determines the betting position where the game chips are placed, the number and type of the game chips that are placed at the particular betting position according to the identification information at the power level 4 that has been calculated. In this case, it is determined according to the identification information [ID0001 through ID0005] that corresponds to the power level 4 of the antenna ANT1, that the game chips Pa through Pe placed at the particular betting position are bet at the betting position opposite the antenna ANT1. At this time, the number and type of the game chips Pa through Pe are determined by directly counting the identification information [ID0001 through ID0005].

According to this embodiment, as described above, when the identification information is read from the game medium (game chip) while varying the output power of the electromagnetic wave, it is possible to prevent the identification information from being read in duplex from the game medium (game chip) placed at the adjacent betting position. Thus it is possible to accurately determine the betting position, the number and type of the game media (game chips) that are placed at the betting position.

Also according to this embodiment, it is possible to determine the betting position, the number and type of the game media (game chips) that are placed at the betting position, without the possibility of erroneous recognition of the betting position of the game medium (game chip) or failure to read, simply by repeating a series of operations (collation process) for all the betting positions.

The embodiment described above has dealt with roulette game that employs game chips as the game media, but the present invention is not limited to this and may be applied to other games (for example, card games that employ cards as the game media). In the case of a card game, every card is provided with a wireless IC chip having RFID that is assigned with a unique identification information, and a plurality of readers (antennas) that are capable of radiating predetermined electromagnetic waves in a direction passing through the betting position are disposed on the back of the game table whereon the card game is played by placing the cards. Then similarly to the embodiment described above, the readers are driven and controlled individually by the controller (the antenna controller having RFID reading function), so as to repeat the series of operations (collation process) for all the betting positions, and it is possible to accurately determine the betting position, the number and type of the game media (game chips) that are placed at the laying position.

In the embodiment described above, the controller may be provided with a function to notify a disparity in the number of game media that have been recognized and/or an illegal act on the occurrence of such a problem. Such a disparity in the number of game media may occur, for example, when the identification information is read from the game media placed at betting positions that adjoin each other, and there is a disparity between the data of different readers that are stored in the ID table. Illegal actions include such a case as mixing game media into the game which do not have the wireless IC chip embedded therein, or the use of game medium of a different gaming house. By providing the controller with the notification function, the dealer or other personnel of the casino are enabled to take quick action if necessary in real time.

Also in the embodiment described above, the game media may have the gaming house identification code assigned thereto. In general, casinos set their own exchange rates between the currency and the game media (game chips). In such a situation, use of game media (game chips) obtained at other gaming house can be prevented by making the game media having the wireless IC chip embedded therein that has the gaming house identification code effective only in the particular gaming house. Thus the system enables various games to proceed smoothly while checking the identification code. The wireless IC chip may also have a code that represents the value of the game chip in addition to the gaming house identification code.

In the game device of the embodiment described above, the controller (the antenna controller 4) that individually drives and controls the plurality of readers (for example, antennas ANT1 through ANT3) in each game table (betting board 2) is provided with both the function as a storage unit for storing the identification information from the game media (for example, the game chips Pa through Pi) as the data of each reader and the function as a collating unit for identifying the game media that are placed at the betting positions by checking the data from the adjacent readers against each other. However, the functions of the reader and collating unit may be allotted to a separate administration server (not shown).

In this case, by connecting the administration server to the game device (for example, the antenna controller 4) via a predetermined interface (not shown), it is possible to carry out various processes (storing operation by the storage unit, collating operation by the collating unit, etc.) for the purpose of determining the position, type and number of the game media that are betted in one or both of the controller (the antenna controller 4) and the administration server. This makes it possible to distribute the load of storing and collating processes requiring a relatively large computing power and thereby makes it possible to identify the game media in a shorter time and more correctly and, as a result, for the game to proceed more smoothly.

Moreover, the administration server may be installed in the gaming house where the game devices of a plurality of types are installed, so as to centrally control the various proceedings of the games played on the different game devices (for example, storing and collating processes required to identify the game media, processing of game history and calculation of the amount of payouts). In this case, in order to reduce the load on the administration server, it is preferable to provide a server (not shown) exclusively for facilitating the game. For example, a storing and collating process server that carries out storing and collating processes for identifying the game media, a PTS (player tracking system) server that carries out the processing of game history and a payout computing server that calculates the amount of payouts may be provided.

Now the operation of the game system that uses such exclusive servers will be described below by taking roulette (refer to FIG. 2) as an example.

First, a dealer turns a roulette wheel (not shown) and throws a roulette ball (not shown) onto the roulette wheel, while each player of the game places the game chips P by hand at a betting position of the game table (betting board 2). At this time, the antenna controller 4 executes the process of reading the identification information from the game chips P in accordance to the identification signal obtained from the wireless IC chip (tag) of the game chip P that has been received via the readers (for example, the antennas ANT1 through ANT3 in FIG. 1A).

At this time, the storing and collating process server stores the identification information that has been read by the antenna controller 4 as the data of each reader while relating the data to the power level of the electromagnetic wave radiated by the reader, and determines the position, number and type of the game chips P that are betted at the betting position by checking the data of adjacent readers against each other, among the data of the readers that are stored in the storage unit. The data related to the betting position, type and number of the betted game chips P that are determined are sent by the storing and collating process server to, for example, the PTS server.

The PTS server determines the betting position, type, number and value (stakes of 1 dollar, 5 dollars, 10 dollars, etc.) of the game chips from the data sent from the storing and collating process server and, based on the results, carries out the predetermined history processing operation for compiling the game history, storing and controlling it. Accordingly, the histories of the roulette games are centrally controlled. The data related to the betting positions and the stakes thus determined are sent by the PTS server to, for example, the payout computing server.

In this case, the roulette wheel is provided with a winning detecting device that determines the settling position of the roulette ball on the roulette wheel and the winning number, and the data obtained by the winning detecting device are sent real time to the payout computing server. At this time, the payout computing server calculates the amount of payout of the roulette game from the settling position of the roulette ball on the roulette wheel, the positions where the game chips P were placed and the stakes (betted amounts) that have been sent from the PTS server. Moreover, a wireless IC tag may be attached to the roulette ball so that the detected data can be obtained from the wireless IC tag of the roulette ball by the winning detecting device.

The game system that employs the exclusive server described above makes it possible to accurately determine the betting position, type and number of the game chips P in a shorter time and more correctly and calculate the payout while centrally controlling the history of the roulette game, so that the roulette game can be carried out smoothly and fairly.

The above detailed description focused on the characteristic portions of the present invention for the sake of understanding. However, the present invention is not limited to the embodiment described above and can be applied to other embodiments, the scope of applications to be interpreted as widely as possible. Terminology and wording employed in this specification are intended to clarify the description of the present invention, and should not be interpreted to restrict the present invention. Those skilled in the art should be able to easily conceive other constitutions, systems and methods that fall within the scope of the present invention. Accordingly, the description in the claims should be interpreted to encompass equivalent constitutions within the scope of the technical concept of the present invention. The abstract is intended to help the Patent Office, public institutions in general and those working in this technical field who are not familiar with the technical terms of patent law and this technical field grasp the technical content and essence of the present invention quickly with brief survey. As such, the abstract should not be understood to limit the scope of the present invention which is defined only by the appended claims. In order to fully appreciate the object and effects of the present invention, it is desired that existing literatures be carefully taken into account.

The above detailed description includes the processes executed by computer or on a computer network. The above description and expressions are given for the purpose of helping those skilled in the art most efficiently understand the present invention. In this specification, the step employed to derive the effect of 1 and the block having a predetermined function should be understood to be a consistent process. In each step or each block, electric or magnetic signals are transmitted, received, recorded or otherwise processed. In the process of each step or each block, such signals are represented by bits, numerical values, symbols, characters, words, numerical figures, etc., although it should be understood that these are used merely for the convenience of description. The process of each step or each block may be described by an expression resembling that of human action, although the processes described in this specification are basically executed by various apparatuses. Other constitutions required to execute each step or each block will be apparent from the description above.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A game device comprising:

a game table where a plurality of laying positions are disposed and a desired number of game media assigned with predetermined identification information can be placed at any of the laying positions;

a plurality of readers that are disposed at the plurality of laying positions, each reader sequentially radiating electromagnetic waves with different power levels in a direction passing through a corresponding laying position and being used to read the identification information from the game media placed at the laying positions, wherein extents of magnetic fields of the electromagnetic waves are varied according to the power levels;

a controller that performs the process of reading the identification information from the game media placed at the laying positions by driving and controlling the plurality of readers, changing the power levels of the electromagnetic waves, and causing the electromagnetic waves to be radiated from the readers;

a storage unit that stores the identification information that has been read by the controller as data for each reader by relating the data to the power level of the electromagnetic waves radiated by the reader; and a collating unit that identifies the game medium placed at the laying position by using the data of the different readers stored in the storage unit in order to collate the data of the adjoining readers with each other, wherein each reader sequentially radiates the electromagnetic waves with the different power levels by radiating a first electromagnetic wave with a first power level at a first time and radiating a second electromagnetic wave with a second power level that is different from the first power level at a second time subsequent to the first time, wherein one of the first and second electromagnetic waves passes through at least one game medium placed on the corresponding laying position and does not pass through at least one game medium placed on a laying position adjacent to the corresponding laying position, and the other of the first and second electromagnetic waves passes through the at least one game medium placed on the corresponding laying position and passes through the at least one game medium placed on the laying position adjacent to the corresponding laying position, wherein the storage unit stores identification information read from the game media at each of the different power levels in each reader, and wherein the collating unit determines a power level at which the readers of the adjacent laying positions do not read overlapped identification information from among the different power levels, and identifies the game medium on each of adjacent laying positions based on identification information read at the determined power level.

2. The game device according to claim 1 wherein the collating unit collates the data of the readers that adjoin each other stored in the storage unit, so as to sort the data into common parts having the same identification information and different parts having different identification information, and calculates the power level of the signal having only the different part without the common part and, according to the identification information at the power level that has been calculated, identifies the game medium that is placed at the betting position.

3. The game device according to claim 1 wherein the identification information includes an identification code unique to the gaming house, and further comprises:

a determining unit that determines whether the identification information that has been read by the controller agrees with the authentic identification code or not; and a memory controller that stores the identification information that has been read by the controller as the data of each of the readers in the storage unit, when the determining unit has determined that the identification code is the authentic identification code.

4. A game system comprising:

a game device that comprises:

a game table where a plurality of laying positions are disposed and a desired number of game media assigned with predetermined identification information can be placed at any of the laying positions;

a plurality of readers that are disposed at the plurality of laying positions, each reader sequentially radiating electromagnetic waves with different power levels in a direction passing through a corresponding laying position and being used to read the identification information from the game medium placed at the laying position, wherein extents of magnetic fields of the electromagnetic waves are varied according to the power levels;

a controller that performs the process of reading the identification information from the game media placed at the laying positions by driving and controlling the plurality of readers, changing the power levels of the electromagnetic waves, and causing the electromagnetic waves to be radiated from the readers; and a transmitting unit that sets the identification information that has been read by the controller in correspondence to the power level of the electromagnetic wave radiated from the reader, and sends it to the outside as the data of each reader; and an administration server that comprises:

a receiver that receives the data of each of the readers sent from the transmitting unit;

a storage unit that stores the data of each of the readers received by the receiver; and a collating unit that identifies the game medium placed at the laying position by using the data of the different readers stored in the storage unit in order to collate the data of the adjoining readers with each other, wherein each reader sequentially radiates the electromagnetic waves with the different power levels by radiating a first electromagnetic wave with a first power level at a first time and radiating a second electromagnetic wave with a second power level that is different from the first power level at a second time subsequent to the first time, wherein one of the first and second electromagnetic waves passes through at least one game medium placed on the corresponding laying position and does not pass through at least one game medium placed on a laying position adjacent to the corresponding laying position, and the other of the first and second electromagnetic waves passes through the at least one game medium placed on the corresponding laying position and passes through the at least one game medium placed on the laying position adjacent to the corresponding laying position, wherein the storage unit stores identification information read from the game media at each of the different power levels in each reader, and wherein the collating unit determines a power level at which the readers of the adjacent laying positions do not read overlapped identification information from among the different power levels, and identifies the game medium on each of adjacent laying positions based on identification information read at the determined power level.

5. The game system according to claim 4 wherein the collating unit collates the data of the readers that adjoin each other stored in the storage unit, so as to sort out the data into common parts having the same identification information and different parts having different identification information, and calculates the power level of the signal having only the different part without the common part and, according to the identification information at the power level that has been calculated, identifies the game medium placed at the laying position.

6. The game system according to claim 4 wherein the identification information includes an identification code that is unique to the gaming house, and the game device further comprises:

a determining unit that determines whether the identification information that has been read by the controller agrees with the authentic identification code or not; and a transmission controller that sends the identification information that has been read by the controller as the data of each reader to the transmitting unit, in case where the determining unit has determined that the identification code is the authentic identification code.

7. The game system according to claim 4 wherein the administration server further comprises:

a value computing unit that calculates the value of the game medium placed at the laying position according to the game medium identified by the collating unit;

a game history compiling unit that compiles the game history according to the value of the game medium calculated by the value computing unit; and a game history controller that stores and controls the game history compiled by the game history compiling unit.

8. The game system according to claim 7 wherein the administration server further comprises a payout computing unit that calculates the amount of payout of the game according to the value of the game media calculated by the value computing unit.

9. The game system according to claim 8 wherein the administration server comprises:

a storage/collation processing server that has the receiver, the storage unit and the collating unit;

a player tracking system server that has the value computing unit, the game history compiling unit and the game history controller; and a payout computing server that has the payout computing unit.

* * * * *